United States Patent [19]

Schewe

[11] 4,354,642

[45] Oct. 19, 1982

[54] PACKAGE SUPPORT APPARATUS FOR FORMING A CREELING TAIL

[75] Inventor: Richard A. Schewe, Rockford, Ill.

[73] Assignee: Barber-Colman Company, Rockford, Ill.

[21] Appl. No.: 78,409

[22] Filed: Sep. 24, 1979

[51] Int. Cl.[3] ..... B65H 54/02; B65H 54/34; B65H 54/42

[52] U.S. Cl. ..... 242/18 PW; 242/18 DD; 242/129.51

[58] Field of Search ..... 242/18 PW, 18 DD, 129.51

[56] References Cited

U.S. PATENT DOCUMENTS

| | | | |
|---|---|---|---|
| 2,747,805 | 5/1956 | Schweiter | 242/18 DD |
| 3,237,876 | 3/1966 | Franzen | 242/18 PW |
| 3,408,011 | 10/1968 | Lenk et al. | 242/18 PW |
| 3,730,447 | 5/1973 | Franzen et al. | 242/18 PW |
| 4,084,759 | 4/1978 | Piro | 242/18 PW |
| 4,116,403 | 9/1978 | Ikeda | 242/18 PW X |
| 4,195,788 | 4/1980 | Miyazaki et al. | 242/18 PW |

FOREIGN PATENT DOCUMENTS

| | | | |
|---|---|---|---|
| 2403341 | 7/1975 | Fed. Rep. of Germany | 242/18 DD |
| 1119002 | 3/1956 | France | 242/18 DD |
| 1213199 | 10/1959 | France | 242/18 DD |
| 782917 | 9/1957 | United Kingdom | 242/18 DD |

*Primary Examiner*—Stanley N. Gilreath
*Attorney, Agent, or Firm*—Robert M. Hammes, Jr.

[57] ABSTRACT

A creeling tail is formed on the large end of a conical package core by tilting the core so that only an end portion at the large end of the core is in contact with a rotating frictional drive and then winding the strand in a narrow band proximate the large end of the core. A package support apparatus is provided to support the conical package core for rotation about its axis and employs means to selectively tilt the core so that only the large end portion of the core is in contact with the frictional drive roll during formation of a creeling tail.

12 Claims, 5 Drawing Figures

PACKAGE SUPPORT APPARATUS FOR FORMING A CREELING TAIL

BACKGROUND OF THE INVENTION

This invention concerns forming a creeling tail on one end of a package core in connection with winding a strand on the core to form a strand package. More particularly, the invention concerns a method and apparatus for forming the creeling tail at the large end of a conical package core.

In winding a strand upon a conical package core, the core is typically supported at its ends for rotation about its axis. The core is rotationally driven through frictional contact with a rotating drive roll, a traversing strand guide being provided to move the strand back and forth along the rotating core so as to produce a helically wound strand package on the core. The core is generally oriented such that a generatrix on the conical surface having a portion in contact with the drive roll is parallel to the axis of the drive roll. While the surface of the drive roll may be uniformly cylindrical, it is preferable to provide the drive roll with a medial portion having an annular surface of larger diameter than the remainder of the drive roll so that the cone is effectively driven by frictional engagement only at a medial portion of the core. It is thus apparent that the large end of the conical core rotates with a higher peripheral speed than the small end thus resulting in greater tension on the strand when it is being wound on the large end of the core. In order to reduce the effect of the winding rate being variable over the length of the core, various types of strand accumulators have been employed to store some of the strand when the winding rate is low at the small end of the core and to release the stored strand when the winding rate is high at the larger end of the core, thus maintaining the tension on the strand substantially uniform during winding. Such strand accumulators may operate satisfactorily when the strand is being wound during the normal winding operation, but they are not able to store enough strand to accommodate forming the creeling tail at the large end of the core since several windings must be made in one place. Thus, the tension on the strand during winding of the creeling tail is so great that strand breakage is a significant problem. This is particularly true when the feed rate from the yarn source is essentially fixed, as, for example, in an open end spinning machine.

In Richard A. Schewe's U.S. Pat. No. 4,138,071 a dual drive for cone winding is disclosed in which the package core is initially effective near the large end of the conical core so that the peripheral speed at the large end of the core during winding of the creeling tail is within normal winding parameters so that high tension problems are substantially eliminated. While this invention works well with conical cores of relatively large diameter, it has been found that when using conical cores having the same length and cone angle but being of smaller diameter, the ratio of the radii at the medial portion and the large end portion is not as great and the drive located near the large end of the core is not sufficiently positive or effective to give good results in all cases.

Regarding another aspect of forming creeling tails, the strand is initially held in position near the large end of the core during forming of the creeling tail by means of a fixed guide located proximate the large end of the core. Heretofore it has been necessary to manually move the strand out of the fixed guide so that it may be picked up by the traversing guide after the creeling tail has been formed. In certain applications, such as in an open end spinning machine having an automation feature for piecing up operations, it is desirable to provide for automatic release and transfer of the strand from the fixed guide to the traversing guide subsequent to forming of the creeling tail.

Thus, there has been a need for a creeling-tail-forming apparatus which provides positive drive at the large end of the conical core in all cases as well as providing for automatic transfer of the strand from the fixed guide to the traversing guide.

SUMMARY OF THE INVENTION

According to the method of the invention, a conical package core is mounted for free rotation about its axis and is tilted so that only a portion of the core proximate its large end is in frictional engagement with a rotating drive roll during winding of a creeling tail. Subsequent to forming of the creeling tail the core is returned to the normal strand winding position in which the core is driven through frictional engagement preferably at its medial portion.

Package support apparatus useful for practicing the method of the invention comprises means to support a conical package core for free rotation about its axis and further comprises means to tilt the core between creeling-tail-forming and package-winding positions to provide for selective engagement of the package core at only the large end of the core during forming of a creeling tail. According to the preferred embodiment of the invention, the package support apparatus is provided with a pair of spaced apart arms having mounting portions which are adapted to support a conical package for rotation about its axis. A mounting portion associated with the arm for supporting the large end of the core comprises an eccentric element rotatable about a center which is fixed with respect to the arm. This element has a cone mounting center which coincides with the axis of the cone, the mounting center being displaced from the fixed center so as to establish an eccentric relationship between the two centers. When the package core is in contact with the frictional drive roll, rotation of the eccentric element about its fixed center results in the package support arm being raised slightly while the large end of the cone is in contact with the drive roll. The two support arms are in fixed relationship with one another so that the support arm for the small end of the conical core is also raised when the element is rotated. Raising the support arms while the large end remains in contact with the drive roll has the effect of tilting the package core so that the drive roll contacts the core at only its large end.

A lever is provided in association with the eccentric element so that the rotation can be accomplished by operating the lever either manually or with automated equipment. After the creeling tail is formed, the lever can be moved such that rotation of the eccentric element returns the package core to the normal package winding position so that the core may be driven through frictional contact with the drive roll at the medial portion of the core.

Transfer of the strand from a fixed guide to a traversing guide is facilitated by providing a fixed guide associated with the eccentric element so that when the element is rotated to the creeling-tail-forming position the fixed guide is moved to a position in which it retains the running strand in a path proximate the large end of the core. A fixed guide is moved out of engagement with the strand when the eccentric element is rotated to return the core to the normal winding position. After the strand is released it is automatically picked up by the traversing guide.

The invention thus provides a method and apparatus for forming a creeling tail suitable for use with a wide range of conical cores and which also can be readily employed with automated equipment which may be associated with the winding apparatus, as for example, in open-end spinning machines. A more complete understanding of the invention and its operation, as well as other objects and advantages thereof, will be apparent from the following detailed description of the invention taken in conjunction with the drawing figures.

DETAILED DESCRIPTION OF THE INVENTION

Figure 1:
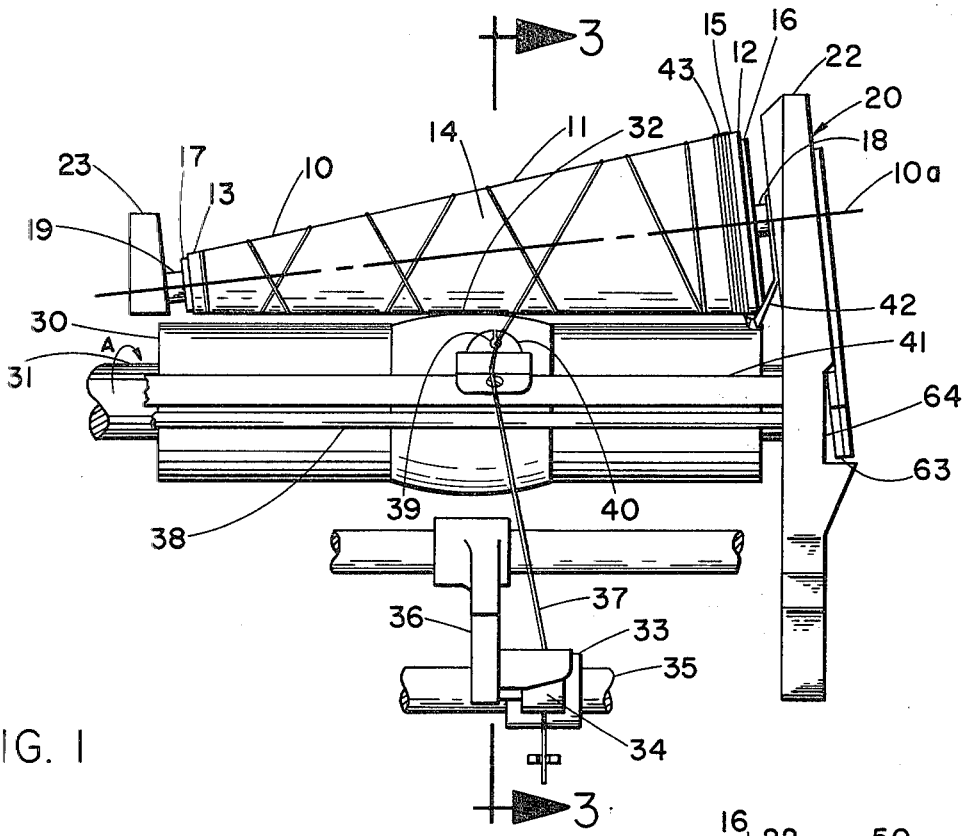
FIG. 1 is a front elevation of a portion of a typical cone winding station, including a package support apparatus according to the invention, in which the core is in the package-winding position.

As shown in FIG. 1, a package core 10 has a conical surface 11 between a large end or base 12 and a small end or nose 13. Intermediate base 12 and nose 13 is an annular medial portion 14 and an annular end portion 15 proximate base 12 which will be described in more detail later. Core 10 is retained between core cups 16, 17 which engage base 12 and nose 13 respectively. Core cups 16, 17 are provided with concentric stubs 18, 19 respectively which facilitate mounting package core 10 for rotation about core axis 10*a* in package support apparatus 20 as hereafter described. Package support apparatus 20 has arms 22, 23 spaced apart from one another which are preferably capable of unitary oscillating movement about an axis 20*a*, shown in FIGS. 3 and 4, to facilitate raising and lowering of the package core 10. In the preferred embodiment shown in FIGS. 3 and 4, arms 22, 23 are connected to a hub 24 mounted for rotation about stationary shaft 25. In order to facilitate raising and lowering of package core 10 at the initiation or completion of package winding, arm 22 is provided with a handle portion 26 extending in front of the winding station. The weight of package support apparatus 20 biases the core 10 toward a drive roll 30.

Drive roll 30 is fixed to a rotating drive shaft 31 substantially parallel to a generatrix of conical surface 11 when core 10 is in the normal winding position shown in FIG. 1, drive shaft 31 being rotatable in the direction of arrow A by means not shown. Drive roll 30 is preferably provided with a medial raised annular drive surface 32 concentric with shaft 31 and drive roll 30. The drive surface 32 is located on drive roll 30 so that it makes contact with the conical surface 11 within medial portion 14 of package core 10. Drive surface 32 is preferably curved to reduce scuffing and in the preferred embodiment is made of urethane molded onto drive roll 30.

During winding, a strand, such as spun yarn, is delivered at a fixed rate through a pair of withdrawal rolls 33, 34. Withdrawal roll 33 is fixed to a rotating shaft 35 which is driven by appropriate means so as to determine the rate of yarn delivery. Withdrawal roll 34 is a pressure or nip roll, mounted on support assembly 36, which frictionally engages withdrawal roll 33 to insure positive feed of strand 37 which runs between the rolls. Strand 37 runs over guide rod 38, through slot 39 of traversing guide 40 and between package core 10 and drive roll 30 as it is wound on the core. Traversing guide 40 is mounted on a reciprocating rod 41 which moves between limits so that the strand is traversed from one end of package core 10 to the other in known fashion, resulting in a helically wound strand package.

In cone winders of this type it is common to provide a tension or yarn compensating device between the withdrawal rolls 33, 34 and traversing guide 39 in order to compensate for differences in the peripheral speed of the package as the yarn traversed from one end to the other. An example of such a compensator is described in Richard A. Schewe's U.S. Pat. No. 4,133,493. For purposes of clarity, a compensator of this type is not shown in the drawings.

Figure 2:
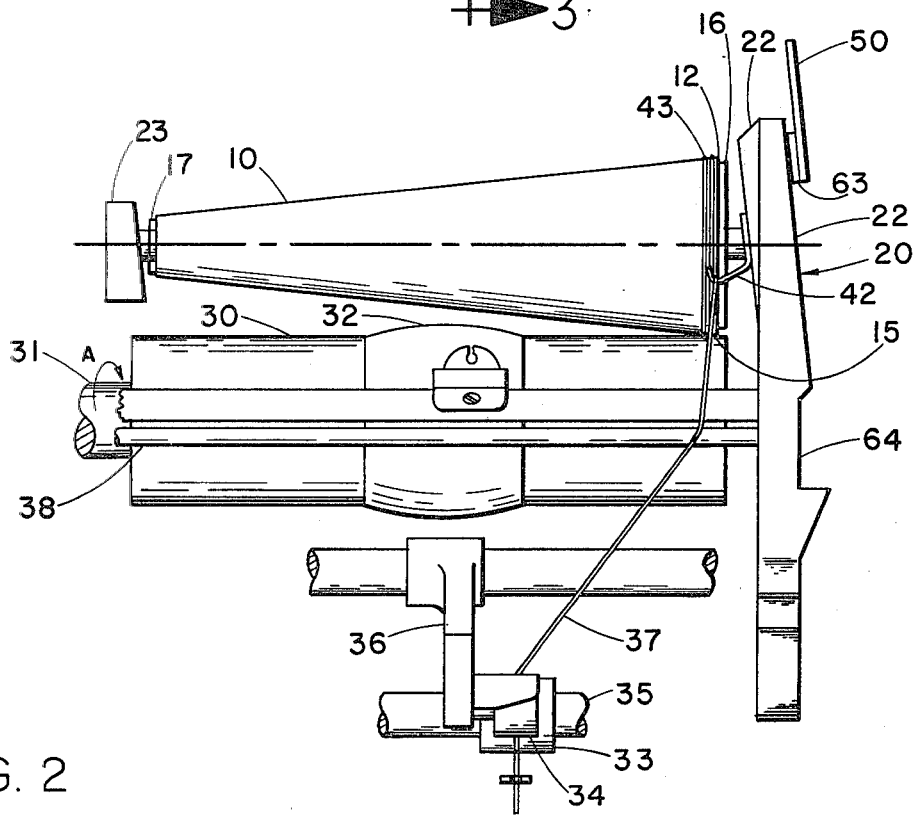
FIG. 2 is a front elevation of the winding station of FIG. 1 with the package core tilted to the creeling-tail-forming position.

A method of forming a creeling tail according to the invention will now be described in more detail. As is well known, a creeling tail comprises several strand windings wound in a narrow band proximate one end of the package core. The creeling tail is used to facilitate piecing-up an end of one strand package to that of another strand package during a creeling operation. In winding conical packages, the creeling tail is formed proximate the base of the conical package core. As previously noted, the peripheral speed at the base of the core is substantially greater than that at the medial portion of the core which is in contact with drive surface 32 during package winding. According to the method of the invention, the foregoing problem is solved by tilting the core 10 as shown in FIG. 2 so that core 10 is in frictional engagement with drive roll 30 at only annular end portion 15 proximate base 12 of core 10. Thus, the peripheral speed near base 12 of core 10 is substantially equal to that at the medial portion during normal package winding. With the core 10 tilted to the creeling-tail-forming position shown in FIG. 2, the strand 37 is delivered at a fixed rate from withdrawal rolls 33, 34 through an open-sided guide 42 near base 12 of core 10 such that the running strand 37 is maintained in a path proximate base 12 so that a creeling tail 43 is wound in a narrow band on end portion 15. After the creeling tail is formed, guide 42 is disengaged from strand 37 as by lowering it to the position shown in FIG. 1. Strand 37 is thereafter picked up by traversing guide 40 as the strand rides over the top of guide 40 and falls into slot 39. As strand 37 is released from guide 42, package core 10 is tilted in the opposite direction to return the core to the normal winding position shown in FIG. 1. Package winding then continues in conventional fashion with the strand package being wound intermediate creeling tail 43 and nose 13 of package core 10.

Figure 3:
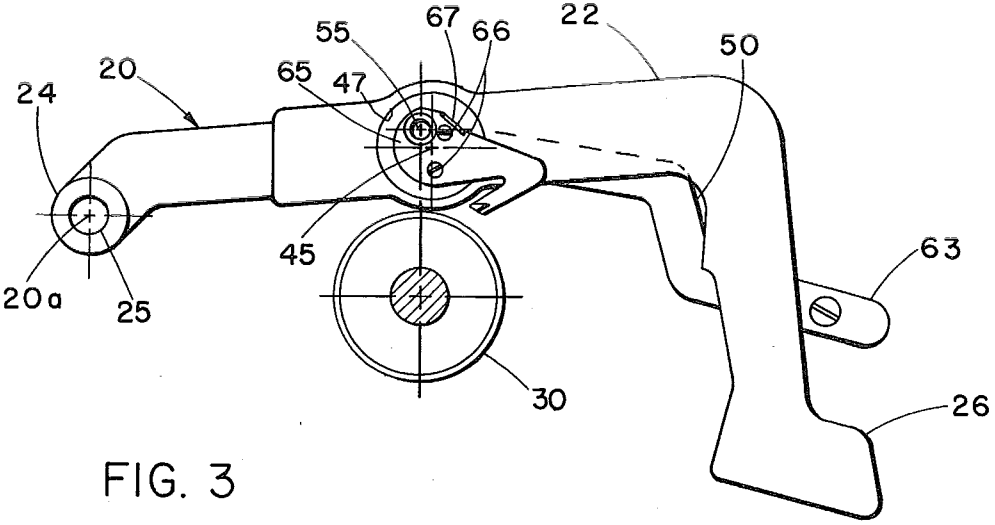
FIG. 3 is a side view of the winding station shown in FIG. 1 taken along the line 3—3, and showing a portion of the winding station without the conical package core and core cup.
Figure 4:
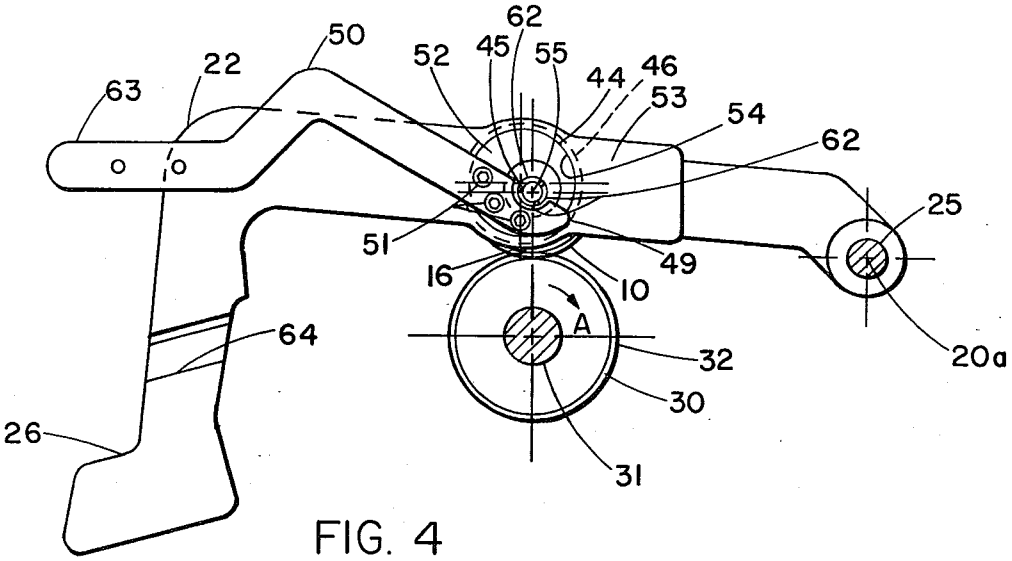
FIG. 4 is a right side view of a portion of the winding station shown in FIG. 2.
Figure 5:
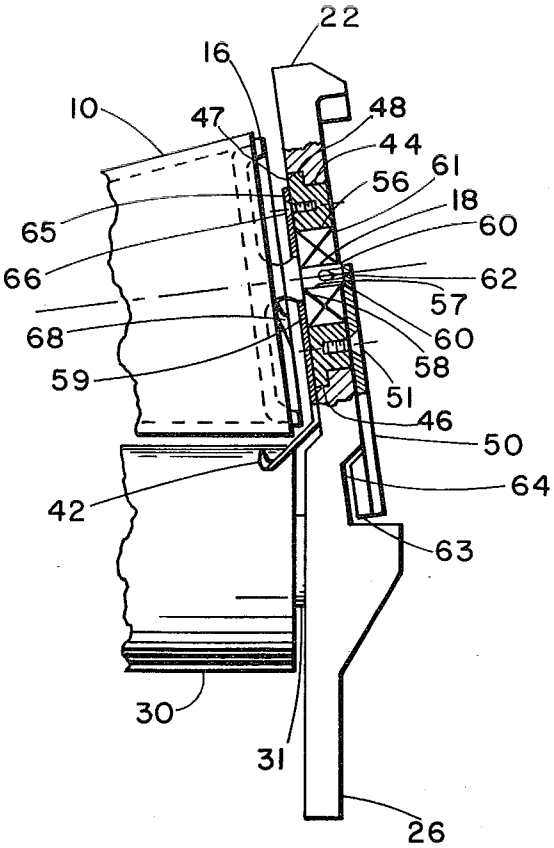
FIG. 5 is a front elevation partially in section, of the right-side portion of the winding station shown in FIG. 1.

In order to accomplish the foregoing method, package support apparatus 20 is provided with means for rotating or tilting package core 10 from end to end along its axis 10*a* between the package-winding position shown in FIG. 1 and the creeling-tail-forming position shown in FIG. 2. Referring to FIGS. 3, 4 and 5, this tilting means comprises an eccentric element, such as circular disc or cartridge 44, rotatable about a center 45 which is fixed with respect to package arm 22. Cartridge 44 has a flange 46 and is located in an opening 47 of arm 22 which is relieved or counter-bored to form a shoulder 48, flange 46 abutting against shoulder 48. In the preferred embodiment cartridge 44 is retained in arm 22 by connecting the retaining portion 49 of lever 50 to cartridge 44 by means of screws 51. Retaining portion 49 is constructed so that it overlaps a portion of both side 52 of cartridge 44 and side 53 of arm 22 thereby preventing lateral movement of cartridge 44. Cartridge 44 is further provided with an opening 54 having a core-mounting center 55 displaced from center 45 for receiving a bearing 56 which may be retained in any convenient manner as by press fit. Stub 18 of core cup 16 is inserted in the bore 57 of bearing 56 so that shoulder 58 of core cup 16 abuts against inside surface 59 of bearing 56. Stub 18 is provided with lip portions 60 which engage outside surface 61 of bearing 56 to retain core cup 16 in position. Core cup 16 is preferably made of molded plastic with stub 18 being split lengthwise to form a plurality of prongs 62 so that it may be compressed radially to facilitate insertion in bore 57. A similar construction is employed with respect to core cup 17.

In addition to retaining cartridge 44 in arm 22, lever 50 provides a suitable means for rotating cartridge 44 either manually or by means of automated equipment. Lever 50 is provided with a handle 63 which is preferably of greater thickness than the remainder of lever 50. When lowered to the package-winding position handle 63 becomes lodged in notch 64 of arm 22, thereby acting as a detent to inhibit accidental movement of lever 50 during package winding.

If cartridge 44 is rotated by raising lever 50 from the position shown in FIG. 3 to the creeling-tail-forming position shown in FIG. 4 it is seen that there is a relative vertical displacement between center 45 and center 55. When a conical package core 10 is supported in package support apparatus 20, rotation of cartridge 44 in this manner results in the base 12 being lowered slightly into contact with drive roll 30 as shown in FIGS. 2 and 4. If cartridge 44 is rotated far enough, arms 22, 23 are raised such that nose 13 of core 10 is also raised resulting in tilting of core 10. Thus, the medial portion 14 of core 10 is disengaged from drive surface 32 so that only annular end portion 15 of package core 10 is in contact with drive roll 30. The degree of tilt has been exaggerated in FIG. 2 for purposes of illustration. In practice, less movement is generally required. Core cups 16, 17 are preferably somewhat flexible and this feature combined with a proper amount of clearance between core stub and bearing bore permit the core 10 to be tilted as previously described. It will be readily apparent to those skilled in the art that tilting of the core 10 can be accomplished in other ways. One example would be to provide a similar eccentric element in association with arm 23 to selectively raise nose 13.

In the preferred embodiment, the open sided guide 42 used to retain the strand near base 12 of cone core 10 during forming of the creeling tail is shown as a hook which is movable vertically to permit disengagement from the running strand 37 subsequent to formation of creeling tail 43. As shown, guide 42 has an associated mounting portion 65 which is fixed to cartridge 44 by a plurality of screws 66 so that guide 42 is rotatable about fixed center 45 in conjunction with the rotation of cartridge 44. Mounting portion 65 may also be conveniently provided with a shear 67 to cut off a loose strand end upon initiation of formation of the creeling tail as described more fully below. In the normal winding position shown in FIGS. 1, 3 and 5 open-sided guide 42 is in a lowered position. When a creeling tail is to be formed, cartridge 44 is rotated to the creeling-tail-forming position as previously described and guide 42 is raised to the position shown in FIGS. 2 and 4. In this position guide 42 is able to engage and maintain the running strand 37 in a path near the base 12 of package core 10 during formation of the creeling tail.

In operation, lever 50 is raised to the position shown in FIGS. 2 and 4 preparatory to initiation of forming of the creeling tail. This action tilts package core 10 so that only annular end portion 15 is in frictional engagement with drive roll 30. In order to facilitate initiation of winding, core cup 16 is provided with a notch 68, shown in FIG. 5, which serves to catch the strand 37 when the end of strand 37 is drawn across base 12 of core 10. As core 10 rotates strand 37 is caught by notch 68 and is drawn between package core 10 and drive roll 30, the free end of strand 37 being brought to shear 67 where it is cut off and removed. Lever 50 is maintained in this position until several windings are made on annular end portion 15 near base 12 of package core 10. Lever 50 is then lowered and package core 10 is returned to the normal package-winding position shown in FIG. 1. Guide 42 is also lowered at the same time so that strand 37 is released and thereafter picked up by traversing guide 40 so that winding of the strand package may commence. If strand 37 is not released quickly enough when core 10 is returned to the package-winding position, the increase in peripheral speed at base 12 resulting when core 10 is driven at its medial portion 14 may result in yarn breakage. Thus, it may be desirable to orient guide 42 such that strand 37 is released sufficiently early to avoid this problem. Thus guide 42 can be so oriented that strand 37 is released before core 10 is completely returned to the normal winding position.

It will be readily apparent to those skilled in the art that numerous alternate embodiments and modifications may be made without departure from the scope and spirit of the invention. Therefore, the embodiments shown and described are considered to be exemplary only and the invention is limited solely by the claims.

I claim:

1. A package support apparatus for use in a strand winding device to support a conical package core in association with a core-rotating frictional drive of said winding device, said conical package core having an annular end portion proximate the large end of said core on the conical surface thereof, said package support apparatus comprising: supporting means having first and second spaced-apart members for supporting said core at respective ends of said core; and means for tilting said core between a creeling-tail-forming position and a package-winding position to permit selective engagement of only said end portion of said core with said frictional drive in said creeling-tail-forming position; said tilting means comprising an eccentric element associated with one of said members and rotatable about a center fixed with respect to said one member, said eccentric element having a core-mounting center displaced from said fixed center, said core-mounting center coinciding with the axis of said core when said core is mounted in said support means.

2. A package support apparatus according to claim 1 wherein said one member supports the large end of said core.

3. Package support apparatus according to claim 1 wherein said tilting means additionally comprises a lever connected to said eccentric element for selectively rotating said eccentric element about said fixed center.

4. Package support apparatus according to claim 1 wherein said first and second members are in fixed relationship with each other.

5. A package support apparatus according to claim 1 wherein said eccentric element comprises a circular disc and said one member has an opening therein concentric with said fixed center for receiving said disc.

6. A package support apparatus according to claim 5 wherein a portion of said eccentric element abuts against a portion of said first member to prevent lateral movement of said eccentric element in one direction.

7. A package support apparatus according to claim 6 wherein said abutting portion of said eccentric element comprises a flange extending beyond the periphery of said disc.

8. A package support apparatus according to claim 7 wherein said opening is relieved to form a shoulder for receiving said flange in abutting relationship.

9. A package support apparatus according to claim 5 additionally comprising a retainer fixed to said eccentric element and overlapping a surface of said first member to prevent lateral movement of said eccentric element in one direction.

10. A package support apparatus according to claim 9 comprising a lever connected to said eccentric element for selectively rotating said eccentric element about said fixed center, said lever comprising said retainer.

11. A package support apparatus according to claim 1 additionally comprising an open-sided guide selectively movable to a strand guiding position to control the disposition of the strand on the annular end portion of said core as a creeling tail is wound in a narrow band on said end portion when said core is tilted to said creeling-tail-forming position.

12. A package support apparatus according to claim 11 wherein said guide is movable with said eccentric element between strand guiding and release positions, corresponding to said creeling-tail-forming and package-winding positions respectively.

* * * * *